US007404373B2

(12) United States Patent
Bailey

(10) Patent No.: US 7,404,373 B2
(45) Date of Patent: Jul. 29, 2008

(54) PORTABLE GAME SCOREBOARD

(76) Inventor: Keith Bailey, 431 KenRidge Dr., Middletown, OH (US) 45042

( * ) Notice: Subject to any disclaimer, the term of this patent is extended or adjusted under 35 U.S.C. 154(b) by 0 days.

(21) Appl. No.: 11/242,445

(22) Filed: Oct. 3, 2005

(65) Prior Publication Data

US 2007/0074650 A1 Apr. 5, 2007

(51) Int. Cl.
*A63F 1/18* (2006.01)

(52) U.S. Cl. ..... 116/223; 116/224; 116/309; 116/318

(58) Field of Classification Search ..... 116/222–224, 116/309, 311, 313, 316, 318; D10/46.1
See application file for complete search history.

(56) References Cited

U.S. PATENT DOCUMENTS

| | | | | | |
|---|---|---|---|---|---|
| 544,907 | A * | 8/1895 | Braine | 116/223 |
| 916,564 | A * | 3/1909 | Kristofek | 116/223 |
| 979,997 | A * | 12/1910 | Pauly | 116/223 |
| 1,502,662 | A * | 7/1924 | De Witt | 116/223 |
| 1,706,646 | A * | 3/1929 | Auer, Jr. | 116/224 |
| 1,785,288 | A * | 12/1930 | Swarthout | 116/223 |
| 1,985,652 | A * | 12/1934 | Campbell | 116/223 |
| 2,842,314 | A * | 7/1958 | McKennett | 235/114 |
| 2,842,614 | A * | 7/1958 | Purington | 386/121 |
| 2,866,601 | A * | 12/1958 | Naber | 235/114 |
| 3,122,851 | A * | 3/1964 | Sepe | 116/223 |
| 3,455,273 | A * | 7/1969 | Willingham, Jr. | 116/223 |
| 3,518,963 | A * | 7/1970 | Tucker | 116/318 |
| 4,026,051 | A * | 5/1977 | Scharrer | 116/309 |
| 4,045,788 | A | 8/1977 | Castelli et al. | 340/323 R |
| 4,251,936 | A | 2/1981 | Ferrell | 40/489 |
| 4,280,291 | A | 7/1981 | Maynes | 40/495 |
| 5,615,636 | A | 4/1997 | Gustafson | 116/223 |
| 7,117,619 | B1 * | 10/2006 | Huber | 40/495 |
| 2004/0016391 | A1 * | 1/2004 | Gordon | 116/223 |

* cited by examiner

*Primary Examiner*—R. A. Smith
*Assistant Examiner*—Tania C Courson
(74) *Attorney, Agent, or Firm*—Wood, Herron & Evans, LLP

(57) ABSTRACT

A game scoreboard for displaying game scores of two opponents, which scoreboard comprises front and rear panels with multiple scoring discs mounted on each of the panels, such that the discs may be overlapped to minimize the size of the scoreboard and optimize game score digits displayed on the front side of the discs.

9 Claims, 4 Drawing Sheets

PORTABLE GAME SCOREBOARD

This invention relates to game scoreboards and, more particularly, to a portable game scoreboard for games which typically involve scores greater than single digit scores as, for example, baseball or volleyball.

BACKGROUND OF THE INVENTION

As the popularity for sports and games continues to grow, there exists a need for affordable, portable scoreboards that allow players and spectators to easily see the score status of the game. Most scoreboards commonly found in use today are large units that are permanently mounted at a venue. These units are expensive and, therefore, are only used in limited venues and fields, and cannot be easily transported to other fields or locations. Portable scoreboards have more general application because they allow the scoreboard to be set up and used in any location. But as presently configured, portable scoreboards are limited in their application.

Many types of portable scoring indicators or scoring devices are currently available, but are relatively impractical for games which require double digit scoring capability. The majority of games played have typical scores that can exceed the display capability of single digit (0-9). Seldom do games require more than double digit capability (00-99). Flip cards, or removable cards, are space efficient; however, they are cumbersome to use and change and are susceptible to damage. Pointers and pegboards are simple to use, but require that all of the numbers be shown, thereby increasing the overall size or limiting the maximum score. Scoring drums require sufficiently large diameter to accommodate all of the digits on their circumference, thus limiting their ability to be used in portable scoreboards.

Many scoreboards utilize discs or wheels with digits printed around the wheel. For low scoring games, a single score wheel design is effective. For higher scoring games, the wheel diameter grows increasingly large with the need to display higher score values. An alternative is to use two wheels, one for the first digit and another for the second digit. This arrangement provides higher scoring capabilities, but overall size of the scoreboard grows, particularly when there are two teams, each requiring two wheels to display the double digit scores. Some wheels can be arranged in a manner so that they overlap, thus reducing the overall size of the scoreboard, but the amount of overlap and relative position of the wheels is limited by the interference of the wheel's axis with other wheels.

In order to be effective, a scoreboard must be easily readable by players and spectators from an appropriate distance that varies based upon the game and the venue. Large, easy-to-read characters and numbers are therefore desirable. There is trade off between large numbers and the overall size of the scoreboard, thus, its overall portability. What is desired is a readily visible scoreboard with relatively large scoring indicia that is low cost, portable and compact enough to conveniently carry to and from each new game location.

It has therefore been an objective of this invention to create a low cost, portable, readily visible scoreboard that can be easily and conveniently transported to game locations and which can be easily stored when not in use.

Still another objective of this invention has been to create a portable scoreboard that is easy to operate, portable and easily mountable upon an available mounting device as, for example, a backstop of a baseball diamond.

SUMMARY OF THE INVENTION

The invention of this application utilizes multiple wheels or discs having digits printed around the periphery of the wheels, but incorporates a novel approach to overcome the limitations imposed by the interference of wheel axles in a multiple wheel, double digit portable scoring device. This is accomplished by utilizing two panels, a front panel having display windows therein and a back panel. Selected wheels and wheel axles are attached only to the front panel while other wheels and wheel axles are attached only to the back panel. Both panels, with the wheels attached, are stacked to form a complete scoreboard. Thereby, the interference of the wheel axles with other wheels is minimized and the compactness of the scoreboard with maximum size digital displays is accomplished.

The scoreboard of this invention comprises a rear ply or panel and a front ply or panel superimposed over the rear ply with a pair of spaced display apertures or windows in the front ply of the scoreboard. A first pair of spaced rotatable scoring wheels or discs are rotatably mounted on the rear side of the front ply or panel of scoreboard with each of the first pair of scoring discs having one digit of a score indicia on a front face thereof aligned with and visible through one of the spaced apertures in the front panel and a second pair of spaced rotatable scoring discs or wheels mounted on the front side of the rear ply or panel with each of this second pair of scoring discs or wheels having one digital score indicia on a front face thereof aligned with and visible through one of the spaced apertures in the front ply of scoreboard.

The advantage of this invention is that it provides a very portable, low cost game scoreboard which maximizes the visibility of the indicia displayed on the board while still minimizing the overall size of the scoreboard. These and other objects and advantages of this invention will be more readily apparent from the following description of the drawings in which.

Figure 1:
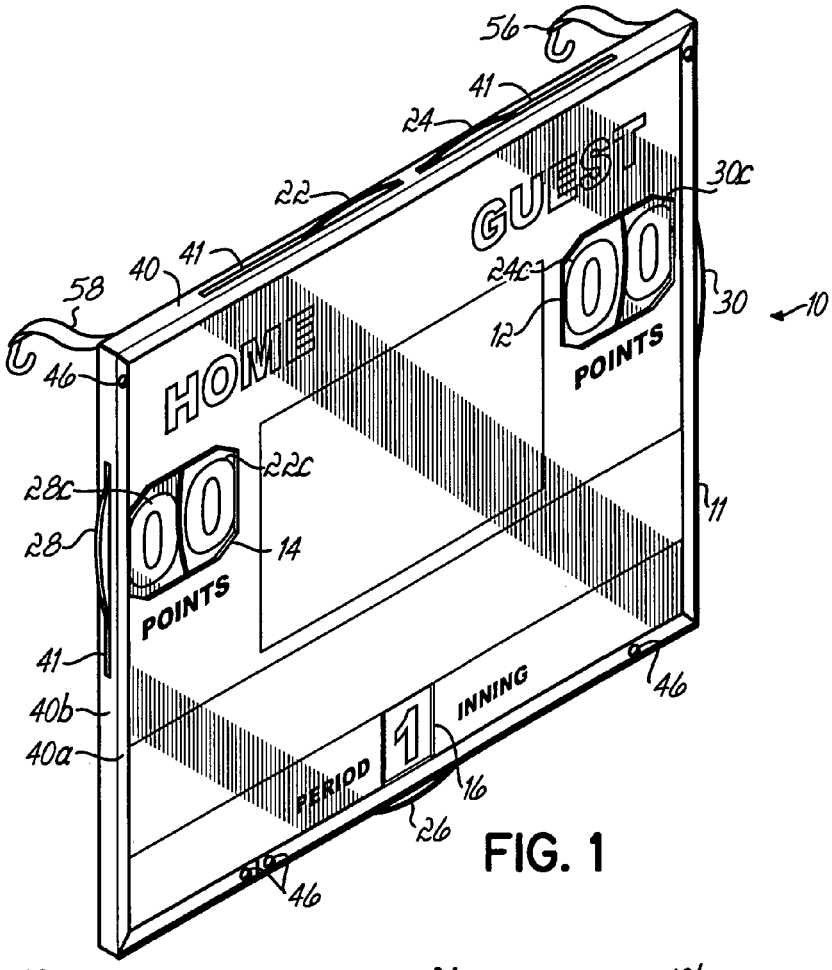
FIG. 1 is a perspective view of a scoreboard incorporating the invention of this application.
Figure 2:
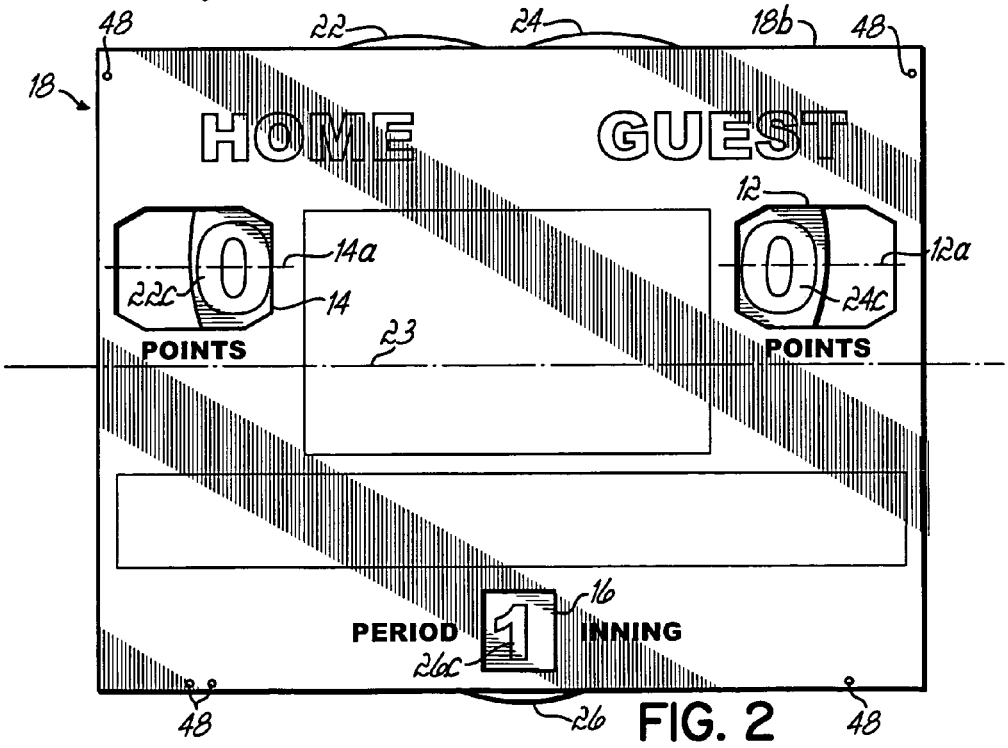
FIG. 2 is a front elevational view of the scoreboard of FIG. 1.

With reference now to FIG. 1, there is illustrated one embodiment of a scoreboard 10 incorporating the invention of this application. This particular scoreboard is illustrated as being applicable to baseball, but with or without minor variations could equally be adapted for use in volleyball, badminton or any number of other games. As there illustrated, the scoreboard has two windows or apertures 12, 14 for displaying the scores of two different teams here identified as "HOME" and "GUEST" and a third window or aperture 16 for displaying the period or inning of the play.

The scoreboard of FIG. 1 comprises a generally rectangular front panel 18 and a similarly sized rectangular rear panel 20. These panels, as well as all of the other components of this scoreboard, are made from plastic so as to be weather impervious. The panels 18,20 are preferably manufactured from corrugated plastic and are stacked, the front panel 18 atop the rear panel 20 with spacers 21*a*-21*d* separating the two panels. The spacers 21*a*-21*d* are in the preferred embodiment adhered or otherwise fixedly attached to the rear surface 18*a* of the front panel 18, but could just as well be attached to the front surface 20*a* of the rear panel 20.

The front panel 18 is distinguishable from the rear panel 20 in that it has the three windows or apertures 12, 14 and 16 extending therethrough. The window 16 is located in the center of the panel 18, but near the bottom while the other two windows 12 and 14 are located on opposite sides of the front panel slightly above a horizontal centerline 23 of the panel 18.

Figure 3:
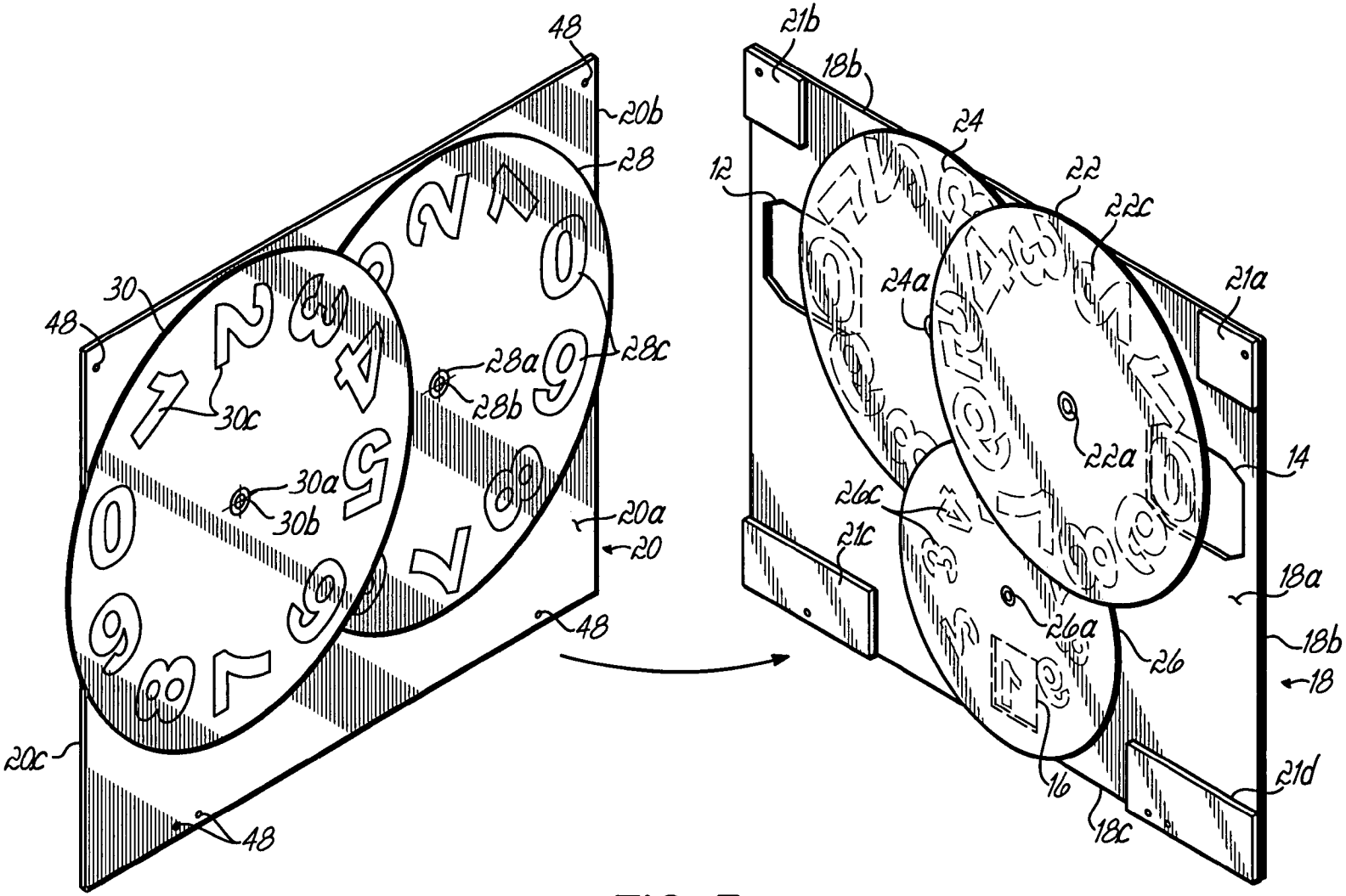
FIG. 3 is an exploded perspective view of the front side of a rear panel and the rear side of the front panel of the scoreboard of FIG. 1.

With reference now to FIG. 3, there is illustrated the two panels 18 and 20 opened outwardly about the right side edge 11 of the scoreboard as viewed in FIG. 1. As so opened, the rear surface 18*a* of the front panel is exposed as is the front surface 20*a* of the rear panel 20. As there illustrated, there are three overlapping scoring discs 22, 24, 26 rotatably mounted on the rear side of the front panel 18 and two overlapping scoring discs 28, 30 rotatably mounted upon the front side of the rear panel 20. Each of these scoring discs has score indicia printed on the front side thereof. The scoring indicia 22*c*, 24*c*, 26*c* on the scoring discs 22, 24 and 26 are shown in phantom in FIG. 4B since those indicia appear on the front side of the scoring disc 22, 24 and 26 while the scoring indicia 28*c*, 30*c* on the discs 28 and 30 are shown in solid lines since the indicia appear on the front face of the discs 28 and 30.

Figure 4A:
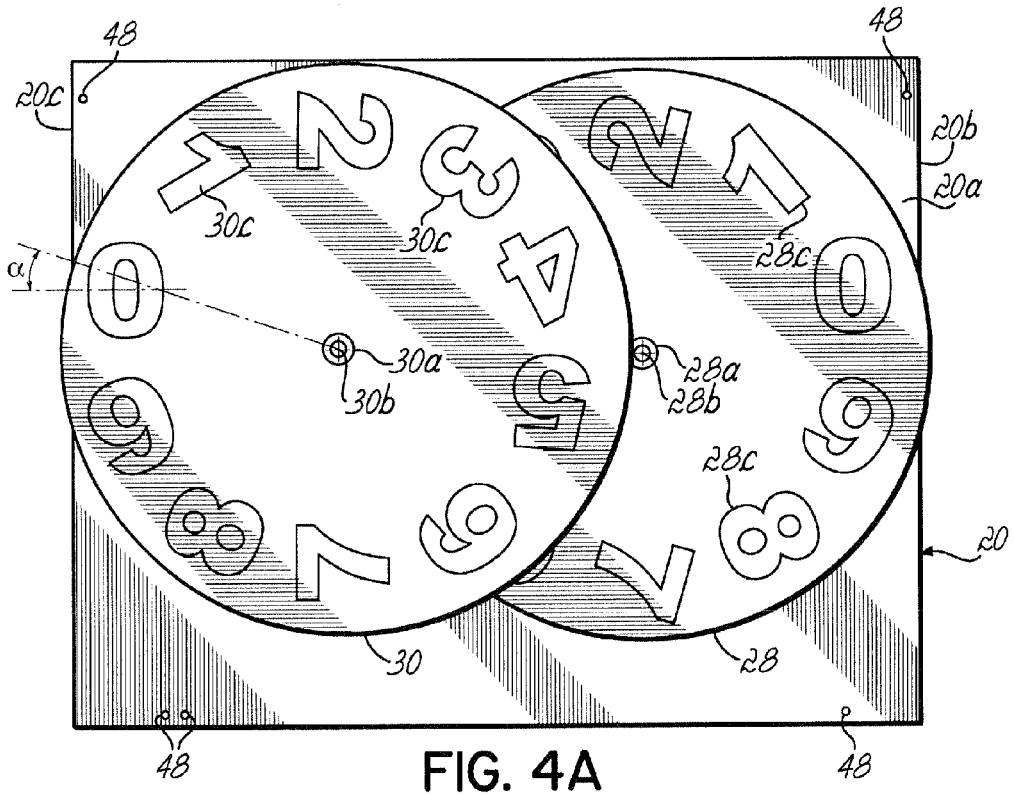
FIG. 4A is a front elevational view of the rear panel of the scoreboard of FIG. 1.
Figure 4B:
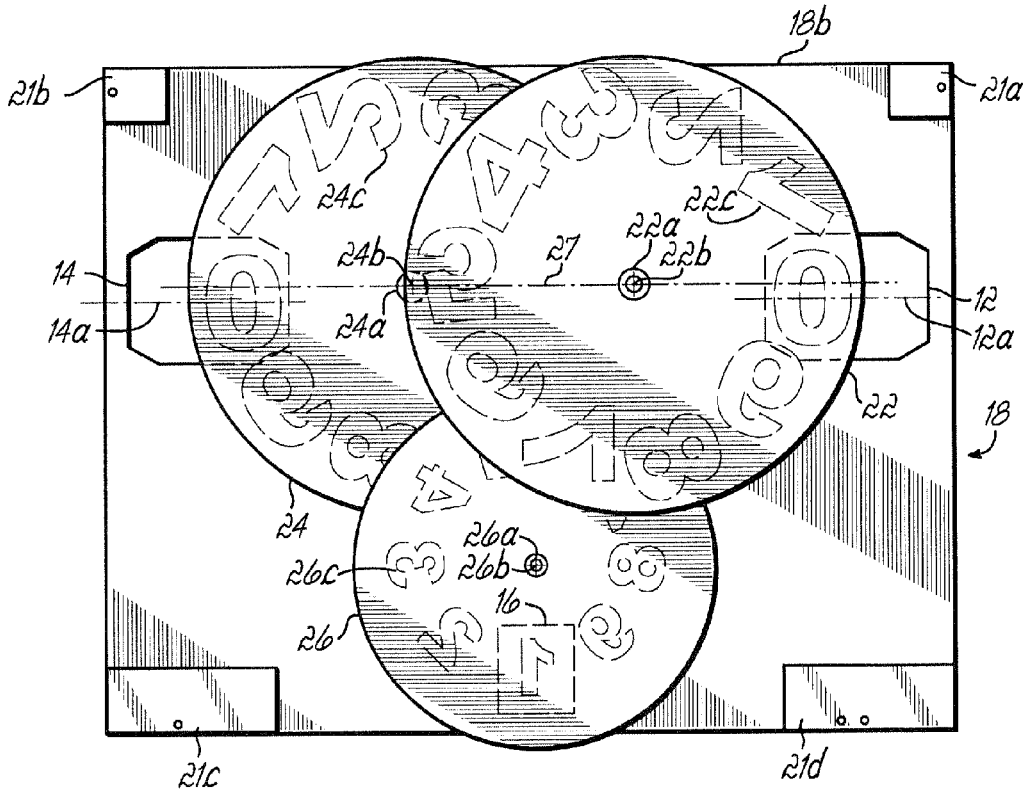
FIG. 4B is a rear elevational view of the front panel of the scoreboard of FIG. 1.

With reference now to FIGS. 3 and 4B, it will be seen that the scoring discs 22, 24, and 26 are rotatably mounted upon plastic axles in the forms of rivets 22*a*, 24*a* and 26*a* which extend through the discs and are headed on the rear side of the discs and the front side of the front panel 18, thereby enabling the discs to be rotated about their respective center axes 22*b*, 24*b* and 26*b*. It will also be noted that the center pivots or axes for the discs 22 and 24 are so positioned relative to the windows 12 and 14, respectively, that indicia printed on the front face of the discs are visible through the windows 12 and 14. It will also be noted that the top edges of the discs extend beyond the top edge 18*b* of the front panel 18. Similarly, the printed indicia on the front face of the lower disc 26 are visible through the lower window or aperture 16 of the front panel and the bottom edge of the disc 26 extends beyond the bottom edge 18*c* of the front panel 18. In order to enable the scoring discs 22, 24 to extend beyond the top edge 18*b* of the front panel 18, the centerline 27 of the two discs 22, 24 is located above the centerline 12*a*, 14*a* of the windows 12 and 14 (see FIG. 4B). In order to have the indicia of the discs 22, 24, though, centered within the windows 12 and 14 when the indicia are located in that window, the indicia 0-9 of each disc 22, 24 is angularly skewed by an angle $\alpha$ of approximately 15° (see FIG. 4A) from a radial line passing through the center of each indicia. Thus, even though the centerline and pivot axes of the scoring discs 22, 24 are located above the horizontal centerline 12*a*, 14*a* of the windows 12 and 14, the indicia are properly vertically centered when located in the window because of this skewed positioning of the indicia on the front face of the discs 22, 24. The indicia 0-9 on the front face of the scoring disc 26 does not need to be angularly skewed since its indicia are all vertically located on radial centerlines of the disc 26.

With reference now to FIGS. 3 and 4A, there is illustrated the rear panel 20 as viewed from the front side. The discs 28 and 30 are rotatably mounted upon the rear panel 20 by headed rivets 28*a*, 30*a*, respectively. Each rivet 28*a*, 30*a* has a large head on the front side of each disc and on the rear side of the panel 20 with the pivot axes 28*b*, 30*b* of the discs being so positioned that the outer edges of the discs extend beyond the side edges 20*b* and 20*c* of the rear panel 20. As was the case with the indicia on the front face of the discs 22, 24 mounted on the front panel 18, the indicia 0-9on the discs 28 and 30 are angularly skewed by an angle $\alpha$ of approximately 15° relative to a radial line through the center of each indicia. This skewing of the indicia on these discs enables the indicia when vertically centered in the windows 12 and 14 of the front panel to be vertically oriented and centered in the window.

Figure 6:
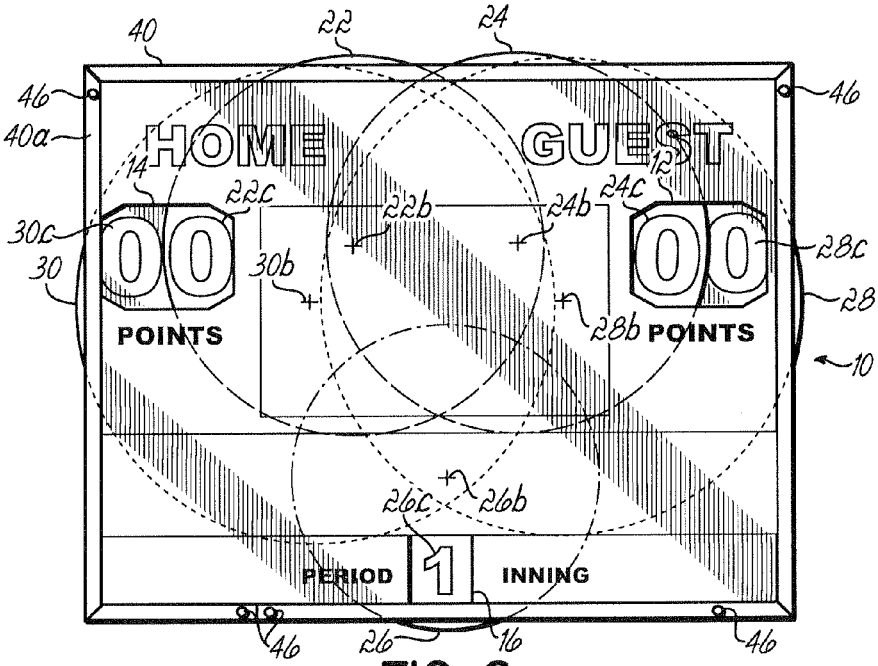
FIG. 6 is a front elevational view of the scoreboard of FIG. 1 illustrating in phantom the relative positioning of all of the scoring discs of the scoreboard of FIG. 1.

To assemble the scoreboard 10, the front panel 18 is overlaid atop the rear panel with the spacers 21*a*-21*d* maintaining a spaced relationship between the two similarly sized rectangular panels 18 and 20 such that the scoring discs attached to these two panels may be freely rotated upon the panels to which the discs are mounted. Because the discs 22, 24 and 26 are rotatably mounted on the front panel 18 independently of any connection to the rear panel and the scoring discs 28 and 30 are freely rotatable upon the panel 20 independently of any connection to the front panel 18, the discs may be overlapped without the pivot axes of the discs limiting the overlap of the discs. This overlap is most clearly visible in FIG. 6 where it may be seen that the discs 28 and 30 overlap the axes 22*b* and 24*b*, respectively, of the scoring discs 22 and 24, but the axles or rivets about which the discs 22 and 24 rotate do not interfere with or limit the overlap. Thereby, the scoreboard is made more compact than would otherwise be possible if the discs were all mounted upon a single panel or if the axles extended through both panels.

With the panels overlaid one atop the other, a plastic U-shaped channel 40 having the corners notched relative thereto is wrapped about the overlaid panels with one side or flange 40*a* of the channel being located on the front side of the front panel 18 and the other side or flange (not shown) of the channel resting against the back side of the rear panel 20. Thereby, the two panels are entrapped within the channel 40 which extends completely about the periphery of the scoreboard 10. There are slots 41 in the web section 40*b* of the channel through which the edges of the discs 22, 24, 26, 28 and 30 extend so as to enable those discs to be manually rotated so as to locate selected indicia on the periphery of those discs within the windows 12, 14 and 16. More specifically, the edges of the discs 28 and 30 extend through slots 41 on opposite sides of the scoreboard and the top edges of the discs 22 and 24 extend through slots 41 in the top of the channel 40. The bottom edge of the disc 26 extends through a slot 41 in the bottom section of the channel 40 such that it may also be manually rotated about its axis to thereby position selected indicia on the front face of the disc 26 in the window 16.

The complete assembly is then maintained in an assembled relationship by plastic rivets 46 which extend through the side flanges of the channel and through holes 48 in the front and rear panels 18 and 20, respectively.

In order that the complete scoreboard is weatherproof and relatively lightweight for portability, all parts of this scoreboard are preferably made of plastic, the front and rear panels being of corrugated plastic, and the scoring discs, as well as the channel 40 and rivets also being of plastic. The scoring discs may be of corrugated plastic, but are preferably made of single ply sheet plastic in order to minimize the thickness and weight of the scoreboard.

It will now be appreciated that when assembled, this scoreboard is relatively compact and that relative to the overall size of the scoreboard, the scoring indicia printed on the scoring discs are large, such that they will be visible from a substantial distance. Absent the overlapping of the scoring discs on the respective panels to which they are mounted and the overlapping of the discs on one panel relative to the axles of the discs on the other panel, compaction of the scoreboard to the extent of the scoreboard 20 would not be possible while still maximizing the size of the scoring indicia.

Figure 5:
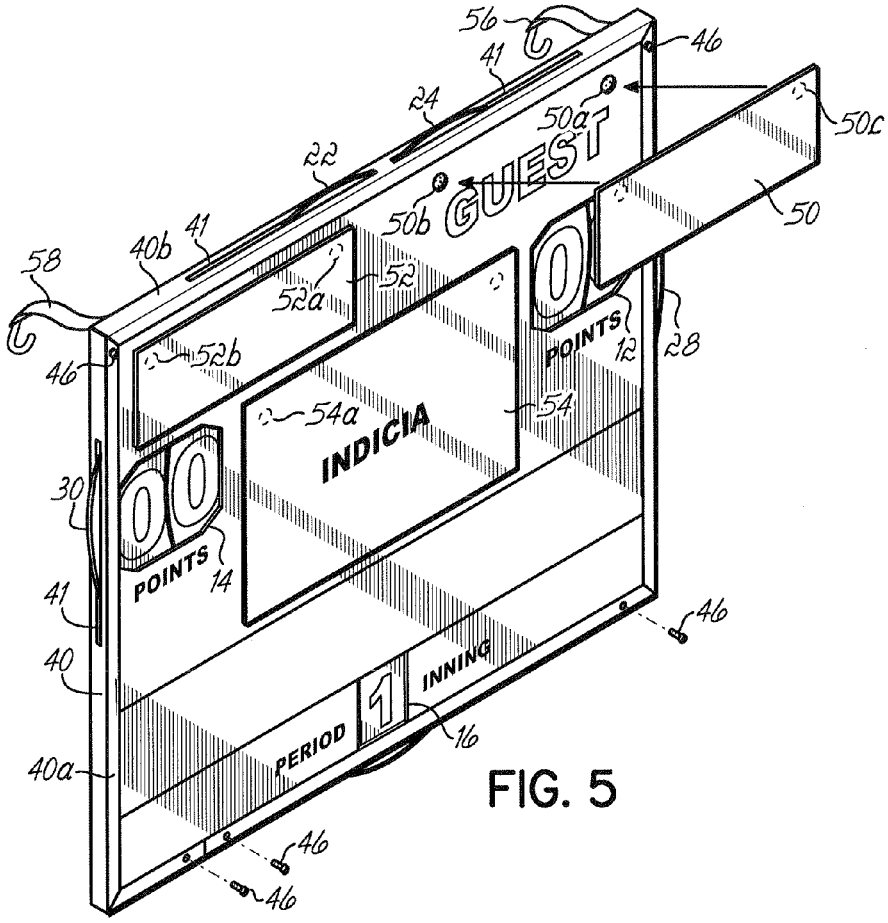
FIG. 5 is a perspective view of a modified version of the scoreboard of FIG. 1.

With reference now to FIG. 5, there is illustrated an embodiment of this invention which, rather than identifying the two players or teams as "HOME" and "GUEST", enables team or player names to be printed on plates 50, 52 and attached to the front face of the scoreboard 10 by velcro or other conventional connectors 50, 50*b* and 50*c*, 52*a* and 52*b*, respectively. Similarly, a plate 54 having indicia printed thereon may be placed on the front face of the scoreboard 10 and attached thereto by velcro or other conventional connectors 54*a*. The indicia on the front plate 54 might well be the name of a sponsor for the team or players or advertising indicia depending upon where or how the scoreboard 10 is used.

The scoreboard 10 may be mounted in any conventional way as, for example, by straps 56, 58 having hooks thereon which may be assembled with a backstop of a baseball diamond if the scoreboard is used for baseball or to any handy post or mounting device located adjacent to the field of play of the game for which the scoreboard is used.

While I have described only two embodiments of the invention of this application, persons skilled in this art will appreciate numerous changes and modifications which may be made without departing from the spirit of my invention. Therefore, I do not intend to be limited except by the scope of the following appended claims.

I claim:

1. A game scoreboard for optimizing the size of at least two digit game score displays for at least two opponents on a relatively minimal size scoreboard, which scoreboard comprises:

a rear panel of scoreboard and a front panel of scoreboard superimposed over the rear panel of scoreboard;

a pair of spaced display windows in said front panel of scoreboard;

a first pair of front panel spaced score discs rotatably mounted on a rear side of said front panel of scoreboard, each of said first pair of front panel score discs having multiple score indicia on a front face thereof with one indicia of a first one of said front panel score discs being selectively alignable with and visible through a first portion of one of said spaced windows on said front panel of said scoreboard and with one indicia of a second one of said front panel mounted score discs selectively alignable with and visible through a first portion of a second one of said spaced windows on said front panel of said scoreboard;

a second pair of rear panel spaced score discs rotatably mounted on a front side of said rear panel of said scoreboard, each of said second pair of rear panel score discs having multiple score indicia on a front face thereof with one indicia of a first one of said rear panel score discs being selectively alignable with and visible through a second portion of said first one of said spaced windows in said front panel of said scoreboard and with one indicia of a second one of said rear panel mounted score discs selectively alignable with and visible through a second portion of said second one of said spaced windows on said front panel of said scoreboard;

said first pair of spaced score discs being rotatably mounted on first and second spaced axes on said front panel of said scoreboard independently of support from said rear panel of said scoreboard and said second pair of spaced score discs being rotatably mounted on third and fourth spaced axes on said rear panel of said scoreboard independently of support from said front panel of said scoreboard, said first, second, third and fourth axes all being spaced from one another; and all of the indicia visible through said first and second windows of said front panel being visible without viewing through a transparent portion of any score disc.

2. The game scoreboard of claim 1 wherein said scoreboard is generally rectangular and has two side edges and top and bottom edges, one of said first and second pair of rotatable score discs extending beyond said side edges of said scoreboard and the other of said first and second pair of rotatable score discs extending beyond the top or bottom side edges of said scoreboard, thereby to enable a portion of said score discs extending beyond the edges of the scoreboard to be manually grasped and moved to change the display indicia visible through said spaced windows.

3. The scoreboard of claim 1 wherein said front and rear panels of said scoreboard are maintained in an assembled relationship by a U-shaped channel extending around the side edges of the scoreboard, said channel having a first flange engageable with the front side of said front panel of the scoreboard and a rear flange engageable with the rear side of said rear panel of scoreboard.

4. The scoreboard of claim 1 wherein said first pair of rotatable score discs are rotatably secured on the rear side of said front panel of scoreboard by a first pair of spaced axles, each of said first pair of axles extending through said front panel and through the center of one of said first pair of rotatable score discs; and said second pair of rotatable score discs being rotatably secured on the front side of said rear panel of scoreboard by a second pair of spaced axles, each of said second pair of spaced axles extending through said rear panel of said scoreboard and through the center of one of said second pair of rotatable score discs.

5. The scoreboard of claim 1 which further includes a fifth rotatably movable disc having multiple indicia on a front face thereof, said fifth disc being selectively movable to position one indicia in alignment with a third window in said front panel.

6. The scoreboard of claim 5 wherein said fifth disc has a portion which extends beyond an edge of said scoreboard to enable said portion of said fifth disc to be manually grasped and moved to change the display of indicia visible through said third window.

7. The scoreboard of claim 1 wherein at least one pair of said scoring discs are rotatably mounted on axles which are overlapped by said other pair of scoring discs.

8. A game scoreboard for optimizing the size of at least two digit game score displays for at least two opponents on a relatively minimal size scoreboard, which scoreboard comprises:

a rear panel of scoreboard and a front panel of scoreboard superimposed over the rear panel of scoreboard;

a pair of spaced display windows in said front panel of scoreboard;

a first pair of front panel spaced score discs rotatably mounted on a rear side of said front panel of scoreboard, each of said first pair of front panel score discs having multiple score indicia on a front face thereof with one indicia of a first one of said front panel score discs being selectively alignable with and visible through a first one of said spaced windows on said front panel of said scoreboard and with one indicia of a second one of said front panel score discs selectively alignable with and visible through a second one of said spaced windows on said front panel of said scoreboard;

a second pair of rear panel spaced score discs rotatably mounted on a front side of said rear panel of scoreboard, each of said second pair of rear panel score discs having multiple score indicia on a front face thereof with one indicia of a first one of said rear panel score discs selectively alignable with and visible through said one of said spaced windows in said front panel of said scoreboard and with one indicia of a second one of said rear panel score discs selectively alignable with and visible through said second one of said spaced windows on said front panel of said scoreboard;

said score discs all being rotatably mounted on axles, which axles are all spaced from one another without any of the axles being coaxial, and at least one axle of each pair of score discs being overlapped by portions of said other pair of score discs.

9. A game scoreboard for optimizing the size of at least two digit game score displays for at least two opponents on a relatively minimal size scoreboard, which scoreboard comprises:

a rear panel of scoreboard and a front panel of scoreboard superimposed over the rear panel of scoreboard;

at least a pair of spaced display windows in said front panel of scoreboard;

a first pair of front panel spaced score discs rotatably mounted on a rear side of said front panel of scoreboard, each of said first pair of front panel score discs having multiple score indicia on a front face thereof;

a second pair of rear panel spaced score discs rotatably mounted on a front side of said rear panel of scoreboard, each of said second pair of rear panel score discs having multiple score indicia on a front face thereof;

one indicia of a first one of said front panel score discs being selectively alignable with one indicia of a first one of said rear panel score discs to indicate a two digit score of one opponent, said two digit score being visible through one of said spaced windows on said front panel of said scoreboard;

one indicia of a second one of said rear panel score discs being selectively alignable with one indicia of a second one of said front panel score discs to indicate a second two digit score of a second opponent, said second two digit score being visible through a second one of said pairs of spaced windows in said front panel of said scoreboard; and said score discs all being rotatably mounted on spaced axles without any of the axles being coaxial, and the spacing of all of the axles being such that all of the indicia visible through said first and second windows of said front panel are visible without viewing through a transparent portion of any other score disc.

* * * * *